US007282136B2

(12) United States Patent
Howdeshell

(10) Patent No.: US 7,282,136 B2
(45) Date of Patent: Oct. 16, 2007

(54) METHOD OF DISPERSING HYDROCARBON FOULANTS IN HYDROCARBON PROCESSING FLUIDS

(75) Inventor: Michael James Howdeshell, Sugar Land, TX (US)

(73) Assignee: Nalco Company, Naperville, IL (US)

( * ) Notice: Subject to any disclaimer, the term of this patent is extended or adjusted under 35 U.S.C. 154(b) by 368 days.

(21) Appl. No.: 10/854,003

(22) Filed: May 26, 2004

(65) Prior Publication Data

US 2005/0263437 A1 Dec. 1, 2005

(51) Int. Cl.
*C10G 9/16* (2006.01)

(52) U.S. Cl. ..... 208/48 AA; 208/48 R; 585/950

(58) Field of Classification Search ..... 208/48 AA, 208/48 R; 585/950
See application file for complete search history.

(56) References Cited

U.S. PATENT DOCUMENTS 3,442,791 A * 5/1969 Gonzalez ..... 208/48 AA

FOREIGN PATENT DOCUMENTS

WO WO 03/103863 12/2003

* cited by examiner

*Primary Examiner*—Glenn Caldarola
*Assistant Examiner*—Prem C. Singh
(74) *Attorney, Agent, or Firm*—Michael B. Martin; Thomas M. Breininger

(57) ABSTRACT

A method of dispersing, dissolving, or reducing the viscosity of hydrocarbon foulants including heavy oil, tars, asphaltenes, polynuclear aromatic hydrocarbons, coke, polymers, light oil, oxidized hydrocarbon and thermal decomposition products, and the like in fluids in contact with hydrocarbon processing equipment comprising contacting the foulant with an effective amount of a halogen-free organic solvent having a density greater than water at the processing temperature.

19 Claims, 7 Drawing Sheets

METHOD OF DISPERSING HYDROCARBON FOULANTS IN HYDROCARBON PROCESSING FLUIDS

TECHNICAL FIELD

This invention concerns a method of removing hydrocarbon foulants including heavy oil, tars, asphaltenes, polynuclear aromatic hydrocarbons, coke, polymers, light oil, oxidized hydrocarbon, thermal decomposition products, and the like from hydrocarbon processing equipment and dispersing the foulants in fluids in contact with the hydrocarbon processing equipment using high-boiling, halogen-free, water immiscible organic solvents.

BACKGROUND OF THE INVENTION

Hydrocarbon processing plants, from refineries to petrochemical plants suffer from fouling as a result of deposition of hydrocarbon foulants onto metallic surfaces of distillation columns, vessels, lines, overheads and other hydrocarbon processing equipment. The hydrocarbon foulants include a wide variety of hydrocarbons that may be present in crude oil as well as the byproducts of hydrocarbon refining processes.

For example, asphaltenes are the heaviest and the most polar components of crude oils. They are generally defined as a solubility class of the polydisperse, high molecular weight hydrocarbons that are insoluble in non-polar solvents. Asphaltene particles are believed to exist in the form of a colloidal dispersion stabilized by other components of the crude oil. These naturally occurring dispersions can be destabilized by a variety of mechanical and chemical conditions involved in oil production and processing. This can result in asphaltene aggregation, precipitation, and eventual deposition of a tarry residue. Other high-molecular weight hydrocarbon foulants include heavy oil, tars, polynuclear aromatic hydrocarbons, coke, and the like.

Other hydrocarbon foulants include polymers, such as those formed from polymerization of styrene, butadiene, cyclopentadiene, and the like, aliphatic and aromatic hydrocarbons having a density less than that of water, commonly referred to as light oil, oxidized hydrocarbons, and thermal decomposition products resulting from the degredation of larger molecules, such as methyl tert-butyl ether, polymers, or other large molecules into smaller molecules.

In ethylene plants, dilution steam systems (DSS) separate and recover ethylene quench water from hydrocarbons, recover heat, and generate steam for pyrolysis furnaces. Dilution steam is essential to reducing the hydrocarbon partial pressure, promoting the formation of ethylene, reducing the formation of undesirable heavier compounds, and reducing coke formation in the furnace tubes. Dilution steam is approximately 50% of the furnace feed. For ethylene units that do not produce enough dilution steam to satisfy the steam-hydrocarbon ratio, about 50 to 150 psig plant steam is then injected into the furnaces.

The DSS incorporates a number of individual functions including process water recovery, hydrocarbon stripping, and dilution steam generation. Each function is closely linked to changes in plant operation i.e., cracking severity, feedstock, and imported or recycle streams.

Ethylene quench water is produced in the quench water tower (QWT) where incoming hot, cracked gas is cooled to a suitable temperature for compression. The cooling is done by spraying cool water from the top of the tower onto upward flowing hot gases. The gases continue to the compression train for processing. These gases contain many molecules that can react and create fouling. This fouling in the compressors can reduce the compressor efficiency. Once enough efficiency is lost, the plant may need to remove the compressor from service to clean it. This can result in an unscheduled shut-down of the ethylene plant.

The gas is often hydrotreated to reduce triple bonds to double bonds. This is typically done with equipment such as an acetylene converter. The converter specifically adds hydrogen molecules to triple bonds creating double-bond molecules. The triple-bond molecules may be highly reactive and easily form heavy, non-volatile molecules that foul the associated equipment.

Major condensation of steam occurs during the quenching operation, which drastically reduces the amount of vapor in the system. In this process a large amount of latent heat is transferred to the process water. This heated process water is used throughout the plant as heating medium, thus recovering a major part of the energy used in the cracking process. A constant low temperature is desired in the top of the QWT.

The high-molecular weight heavy tars that accumulate in the QWT greatly reduce heat transfer, and this affects how well the QWT works. Without efficient heat transfer, the overhead gases enter the compression train at a higher temperature. Once the temperature limit is reached, the rates must be reduced until, ultimately, the plant will need to be shut down to clean the QWT.

After the quenching process, the water stream flows to the QWSD. This water stream is typically a combination of pyrolysis gasoline, process water, recycle quench water, and tars of heavy hydrocarbons. The pyrolysis gasoline in the settler migrates to the top of the drum where it is removed. This stream is commonly known as pygas. The tars or heavy hydrocarbon are usually collected at the bottom of the drum. These are the hydrocarbons that are heavier than water. Not every QWSD is equipped for this phase separation, and in many plants the drain or bottom line(s) may plug because of low flow rates and the heavy, polymer-like composition of the stream.

The process water and recycle quench water need adequate retention time in the QWSD to achieve separation from the hydrocarbon phases. Close to the bottom of the QWSD, the water is pumped away to feed the coalescer unit or the process water stripper (PWS) or both to be further cleaned before steam generation. Hydrocarbon that is carried downstream will reduce the operating efficiency of the downstream units.

Heavy tars accumulate in the bottom of the QWSD, and from a combination of low flow rates, high viscosity, and relatively high freeze points the bottom lines can plug. Once the lines are plugged, the tar builds up, and eventually accumulates enough inventory to affect downstream units.

The heavy tars that accumulate in the QWT and QWSD are notoriously difficult to remove. Consequently, there is an ongoing need for new methods and compositions to effectively remove these foulants in order to prevent system interruptions for cleaning, protect downstream equipment, and increase the overall efficiency of hydrocarbon refining processes.

SUMMARY OF THE INVENTION

This invention, however, is not limited to use in the quench water recovery sytem. Because of its low vapor pressure and high solvency, the organic solvent of this invention is generally useful for the purpose of reducing the overhead entrainment of heavier components in a distillation operation. By introducing the organic solvent of this invention into the top of the distillation column or into the reflux, it will act to dissolve heavier components, reducing the amount entrained in the rising vapor.

The organic solvent of this invention may also have beneficial effects on operations beyond those of its primary use. Its higher solvency allows it to function as a cleaning agent, removing heavier components of the process that have precipitated onto, for example, the internal walls of the charge gas compressor in an ethylene plant. This may be accomplished by direct injection onto each wheel or into the suction of the compressor. Similarly, the organic solvent of this invention may be used to clean catalytic surfaces, such as those of pyrolysis gas hydrotreators and acetylene converters. The accumulation of tars and heavier hydrocarbons on these catalyst beds restricts the contact of the process stream with the catalyst, resulting in inefficient reaction. Injection of the organic solvent with the feed to such catalytic units could remove the tars and heavier hydrocarbons to present a cleaner catalytic surface to the process stream. Use in this manner can be effective for fixed-bed catalytic reactors.

Accordingly, this invention is a method of dispersing hydrocarbon foulants in fluids in contact with hydrocarbon processing equipment, comprising contacting the foulants with an effective dispersing amount of a halogen-free, water immiscible organic solvent having a density greater than water at the process temperature.

DETAILED DESCRIPTION OF THE INVENTION

Definitions of Terms

Figure 1:
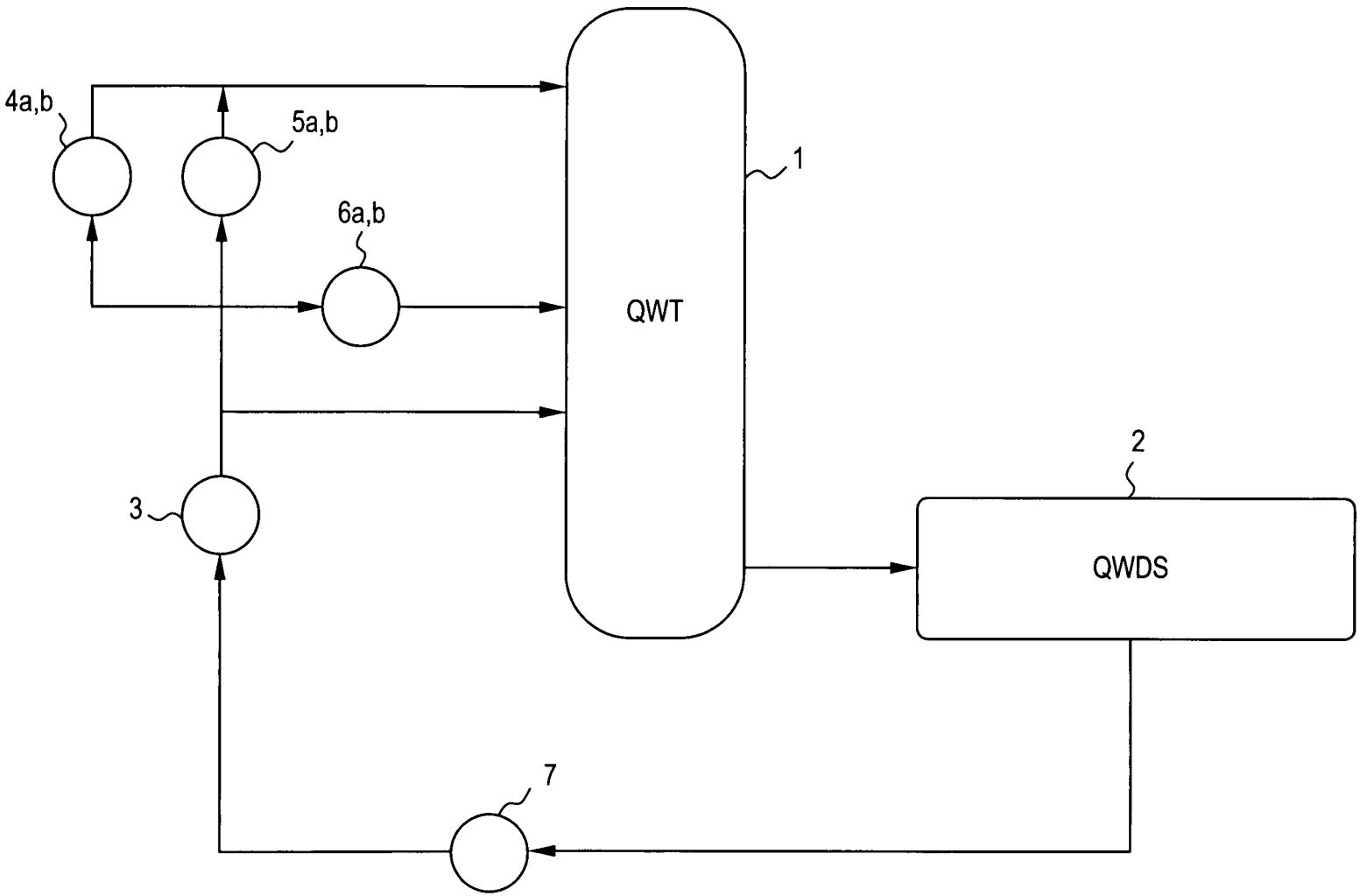
FIG. 1 is a schematic diagram of a representative quench water loop showing the quench water tower 1, quench water drum separator 2, fin fan 3, and heat exchangers 4*a*, 4*b*, 5*a*, 5*b*, 6*a*, 6*b* and 7.

"Alkenyl" means a monovalent group derived from a straight or branched chain hydrocarbon containing 1 or more carbon-carbon double bonds by the removal of a single hydrogen atom. Representative alkenyl groups include ethenyl, propenyl, butenyl, 1-methyl-2-buten-1-yl and the like.

"Alkoxy" means an alkyl-O— group where alkyl is defined herein. Representative alkoxy groups include methoxy, ethoxy, propoxy, butoxy, and the like.

"Alkyl" means a monovalent group derived from a straight or branched chain saturated hydrocarbon by the removal of a single hydrogen atom. Representative alkyl groups include ethyl, n- and iso-propyl, n-, sec-, iso- and tert-butyl, lauryl, octadecyl, and the like.

"Alkylene" means a divalent group derived from a straight or branched chain saturated hydrocarbon by the removal of two hydrogen atoms. Representative alkylene groups include methylene, ethylene, propylene, isobutylene, and the like.

"Aryl" means substituted and unsubstituted aromatic carbocyclic radicals and substituted and unsubstituted aromatic heterocyclic radicals having about 5 to about 14 ring atoms. Representative aryl include phenyl naphthyl, phenanthryl, anthracyl, pyridyl, furyl, pyrrolyl, quinolyl, thienyl, thiazolyl, pyrimidyl, indolyl, and the like. The aryl is optionally substituted with one or more groups selected from hydroxy, $C_1$-$C_3$ alkyl and $C_1$-$C_3$ alkoxy.

"Arylalkyl" means an aryl-alkylene-group wherein aryl and alkylene are defined herein. Representative arylalkyl include benzyl, phenylethyl, phenylpropyl, 1-naphthylmethyl, and the like.

"Hydrocarbon foulant" means hydrocarbon-based materials which form a component of deposits on hydrocarbon processing equipment. The hydrocarbon foulant may be incorporated into the deposit or entrained in the hydrocarbon processing fluids, typically as amorphous solids which have not yet been incorporated into the deposit. Hydrocarbon foulants include polydisperse, high-molecular weight hydrocarbon which is insoluble in non-polar solvents such as heavy oil, tars, asphaltenes, polynuclear aromatic hydrocarbons, coke, and the like and hydrocarbon-based materials having a density less than water including polymers, light oil, oxidized hydrocarbon, thermal decomposition products, and the like.

"Process temperature" means the temperature at which the cleaning described herein is performed.

"Processing fluid" means an aqueous liquid or non aqueous liquid or gas. Processing fluids include hydrocarbon processing streams and fluids adapted to accomplish the cleaning as described herein. Representative processing fluids include water, condensed hydrocarbon, ethylene gas, and the like.

"Substituted anisole" means a compound of formula $C_6H_5OCH_3$ wherein one or more of the aromatic hydrogen atoms is replaced with one or more groups selected from alkyl, alkoxy and nitro. A representative substituted anisole is nitroanisole.

"Substituted cyanoacetic acid" means a compound of formula NCCH2CO2R' where R' is selected from alkyl, aryl and arylalkyl. A representative substituted cyanoacetic acid is methyl cyanoacetate.

"Substituted maleic acid" means a compound of formula R'O2CCH═CHCO2R" wherein R' and R" are independently selected from H, alkyl, aryl and arylalkyl, provided R' and R" are not both H. Preferred substituted maleic acids include $C_1$-$C_3$ maleic acid alkyl esters. More preferred substituted maleic acids include dimethyl maleate, diethyl maleate, and the like.

"Substituted phenol" means a compound of formula $C_6H_4OH$ and oxyalkylated derivatives thereof wherein one or more of the aromatic hydrogen atoms is replaced with a group selected from alkyl, alkoxy and nitro. Representative substituted phenols include ethoxylated nonylphenol, propoxylated butylphenol, and the like.

"Substituted phthalic acid" means a compound of formula $C_6H_4(CO_2R')_2$ where R' is selected from alkyl, aryl and arylalkyl and one or more of the aromatic hydrogen atoms is optionally replaced with a group selected from alkyl, alkoxy and nitro. Preferred substituted maleic acids include $C_1$-$C_3$ phthalic acid alkyl esters. More preferred substituted phthalic acids include dimethyl phthalate, diethyl phthalate, and the like.

Preferred Embodiments

Organic solvents suitable for use as dispersants according to this invention are suitably selected from a wide variety of solvents having a density greater than that of water and the ability to disperse, dissolve, or reduce the viscosity of the hydrocarbon foulants in processing fluids at the process temperature, such that entrained hydrocarbon foulants and deposits comprising the hydrocarbon foulants are dispersed and transported in the process fluid. Preferred organic solvents include substituted phenols, substituted phthalic acids, substituted maleic acids, substituted anisoles and substituted cyanoacetic acids.

In a preferred aspect of this invenion, the organic solvent is selected from the group consisting of dimethyl maleate, diethyl phthalate, dimethyl phthalate, methyl cyanoacetate and 2-nitroanisole.

In another preferred aspect, the organic solvent is selected from the group consisting of dimethyl maleate, diethyl phthalate and dimethyl phthalate.

In a more preferred aspect, the organic solvent is dimethyl phthalate.

The organic solvents can be used to clean hydrocarbon processing equipment and disperse, dissolve, or reduce the viscosity of low to high molecular weight foulants in fluids in contact with the equipment. The solvents may be used neat or as a solution in other solvents. Liquid organic solvents according to this invention can be heated. Organic solvents that are solids at ambient temperature can be melted, and the hot, liquid solvent can be used to melt and then solvate the foulant, such that it remains solvated in the hydrocarbon fluid at ambient temperature.

In a preferred aspect of this invention, the hydrocarbon foulant is selected from the group consisting of heavy oil, tars, asphaltenes, polynuclear aromatic hydrocarbons, and coke.

In another preferred aspect, the hydrocarbon processing equipment is refinery equipment.

In another preferred aspect, the refinery equipment is a hydrotreator.

In another preferred aspect, the hydrocarbon processing equipment is ethylene plant equipment.

In another preferred aspect, the hydrocarbon processing equipment is hydrotreating equipment.

In another preferred aspect, the hydrocarbon processing equipment is the compressor.

In another preferred aspect, the hydrocarbon processing equipment is acetylene convertor.

In another preferred aspect, the hydrocarbon processing equipment is the ethylene furnace.

In another preferred aspect, the hydrocarbon processing equipment is dilution steam system processing equipment.

In another preferred aspect, the hydrocarbon processing equipment is the quench water tower.

In another preferred aspect, the hydrocarbon processing equipment is the quench water separator.

In another preferred aspect, the hydrocarbon processing equipment is the bottom lines, storage tanks, vessels, pumps, and the like associated with the quench water separator drum.

The effective amount of organic solvent and its method of application depends on the nature of the foulant, the processing fluid, and the processing equipment that is being cleaned.

For example, for cleaning the QWT, the solvent dosage ranges from about 10 ppm to about 5 weight percent, preferably about 0.5 to about 5 weight percent based on the cleaning fluid in the system. The organic solvent is preferably diluted with an unsaturated hydrocarbon solvent such as debenzenized aromatic condensate or heavy aromatic condensate and co-injected into the QWT with the returning quench water. It can be injected neat. It can be used in a batch or a continuous treatment. The organic solvent can be used alone or in combination with other typical QWT treatments (including those for pH adjustment and emulsion breaking).

The high-molecular weight, heavy tars that accumulate in the QWT are difficult to disperse. Most on-line cleaning products do not work well on the high-molecular weight foulant or create a bad emulsion in the water or both, all of which may affect downstream operations. The organic solvent greatly helps in cleaning the tower and keeping the heavy tar material dispersed in the hydrocarbon phase. This means the foulant is removed from the tower and will not affect downstream operations in the DSS.

For cleaning the heavy tar removal line in the QWSD the organic solvent is administered neat at a dosage of about 10 to about 1000 gallons for initial tar removal and about 0.5 to about 50 gallons/day/separator to keep the unit clean (maintenance). The preferred dosage is about 100 to about 400 gallons to initially remove the tar and about 1 to about 5 gallons/day/separator to keep the unit clean. Cleaning is done in a batch-wise or slug method. Maintaining cleanliness is done either in a batch-wise or slug method or continuously. In this application, the organic solvent of the invention may be co-injected with other treatments, and can also be used while other treatments are occurring in the quench water separator. The injection must be into the bottom of the quench water separator and can not mix with the light hydrocarbon layer. The organic solvent is able to keep the bottom lines open because it has a relatively low viscosity at the quench water separator operating temperature, thereby allowing the tar to be continuously removed and the lines to remain open. The tar is removed, collected, and disposed.

The typical organic solvent dosage for high-temperature cleaning operations is at least about 10 ppm. The effective dosage will depend on the foulant and location. Cleaning is done as a batch/slug treatment, and the temperature can range from about 5° C. to about 275° C. at ambient pressure. The cleaning is typically done with the organic solvent alone or in conjunction with other treatments. Other cleaning chemicals may be used in conjunction with the organic solvent. An advantage of this invention over current solutions is that the method works at high temperatures, and at high temperatures it is likely that the cleaning time will be reduced.

The foregoing may be better understood by reference to the following examples, which are presented for purposes of illustration and are not intended to limit the scope of this invention.

EXAMPLE 1

Laboratory Testing.

Quench water, light hydrocarbon and foulant samples are collected from the quench water drum separator of a southern U.S. ethylene plant. Approximately 5 grams of foulant are smeared along the bottom of a two ounce glass bottle and approximately 30 mL of quench water is added to the jar. A control sample is set up along with a test sample. Five mL of dimethyl phthalate ("DMP") are added to the test bottle, and both bottles are gently shaken. The dimethyl phthalate quickly reduces the viscosity of the foulant. The dimethyl phthalate also remains in the bottom of the bottle as expected based on its density.

EXAMPLE 2

On-Site Testing.

Testing as described in Example 1 is also conducted at the ethylene plant on fresh samples. During this testing, dimethyl phthalate, when combined in the customer's heavy aromatic distillate (HAD) solvent, did an excellent job at dispersing tars, asphaltenes and coke fines and keeping the foulant suspended in the stream.

EXAMPLE 3

Ethylene Plant On-Line Cleaning Trial.

The trial consists of three phases. The first phase is circulating a solution of 1% DMP in hydrocarbon solvent (injected continuously at two L/minute) through the quench water loop and tower of the ethylene plant to clean the quench tower and heat exchangers. FIG. 1 shows the quench water tower 1 (QWT), the quench water drum separator 2 (QWDS), the fin fan 3 and the heat exchangers 4, 5, 6 and 7. FIGS. 2-5 show the heat transfer efficiencies of the different heat exchangers in the quench loop. The heat efficiency is measured as the percent of the design U coefficient.

Figure 2:
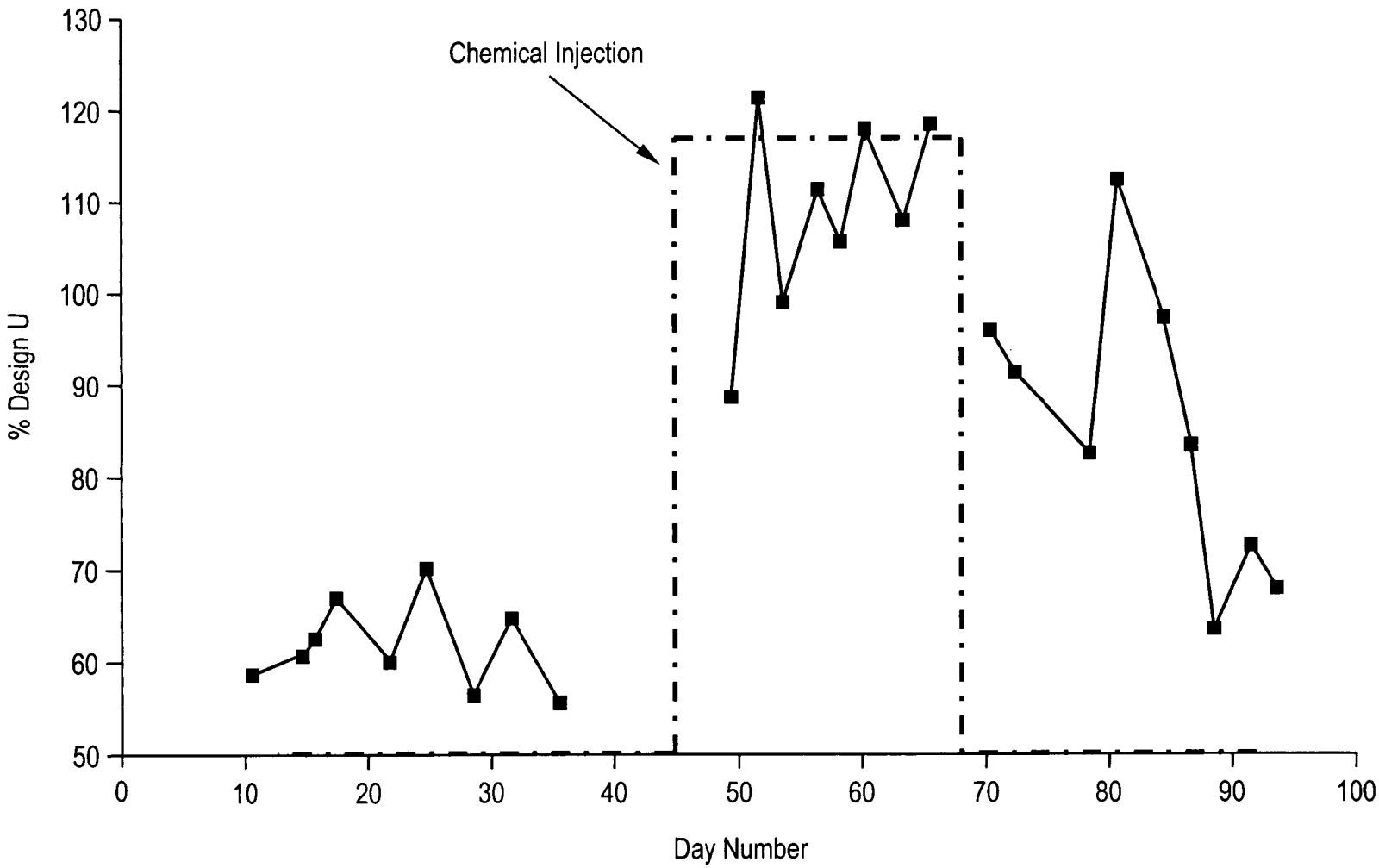
FIG. 2 is a plot of fin fan 3 efficiency data (as percent design U) vs time both before and after cleaning with organic solvents according to this invention.

FIG. 2 shows the Fin Fan heat exchanger bank 3 U value data. The bank of fin fans is difficult to isolate, so they are rarely cleaned. As shown in FIG. 2, the fin fans show an immediate and dramatic improvement after the DMP injection begins.

Figure 3:
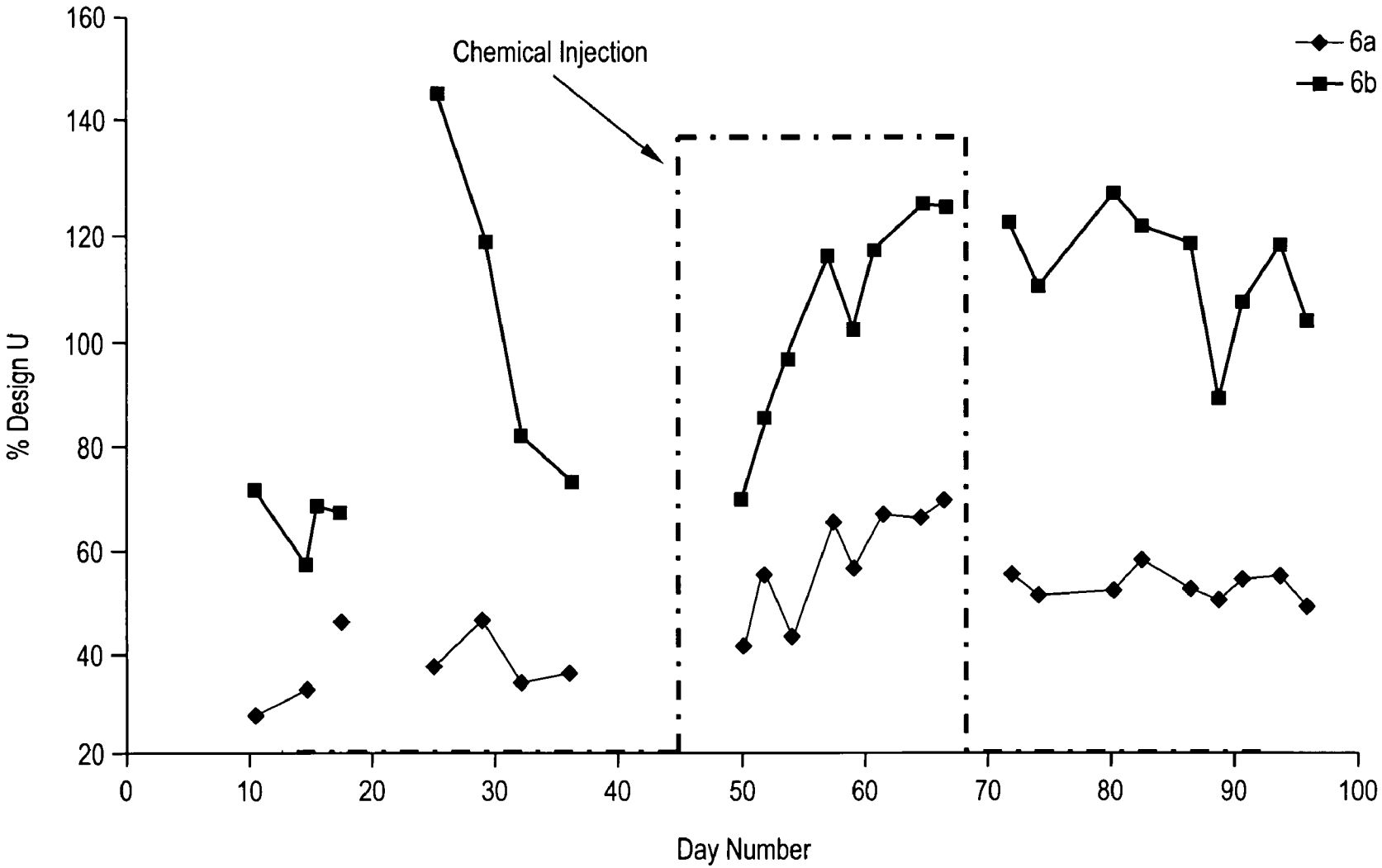
FIG. 3 is a plot of heat exchanger 6*a* and 6*b* efficiency data (as percent design U) vs time both before and after cleaning with organic solvents according to this invention.

FIG. 3 shows the data for heat exchangers 6*a* and 6*b*. These heat exchangers feed the middle section of the quench tower. The heat exchangers are trending downward, especially 6*b*, before the DMP injection. The first data point on 6*b* after the DMP injection still trends downward, but the second point trends sharply upward. The 6*a* efficiency is also trending upward after the DMP injection.

Figure 4:
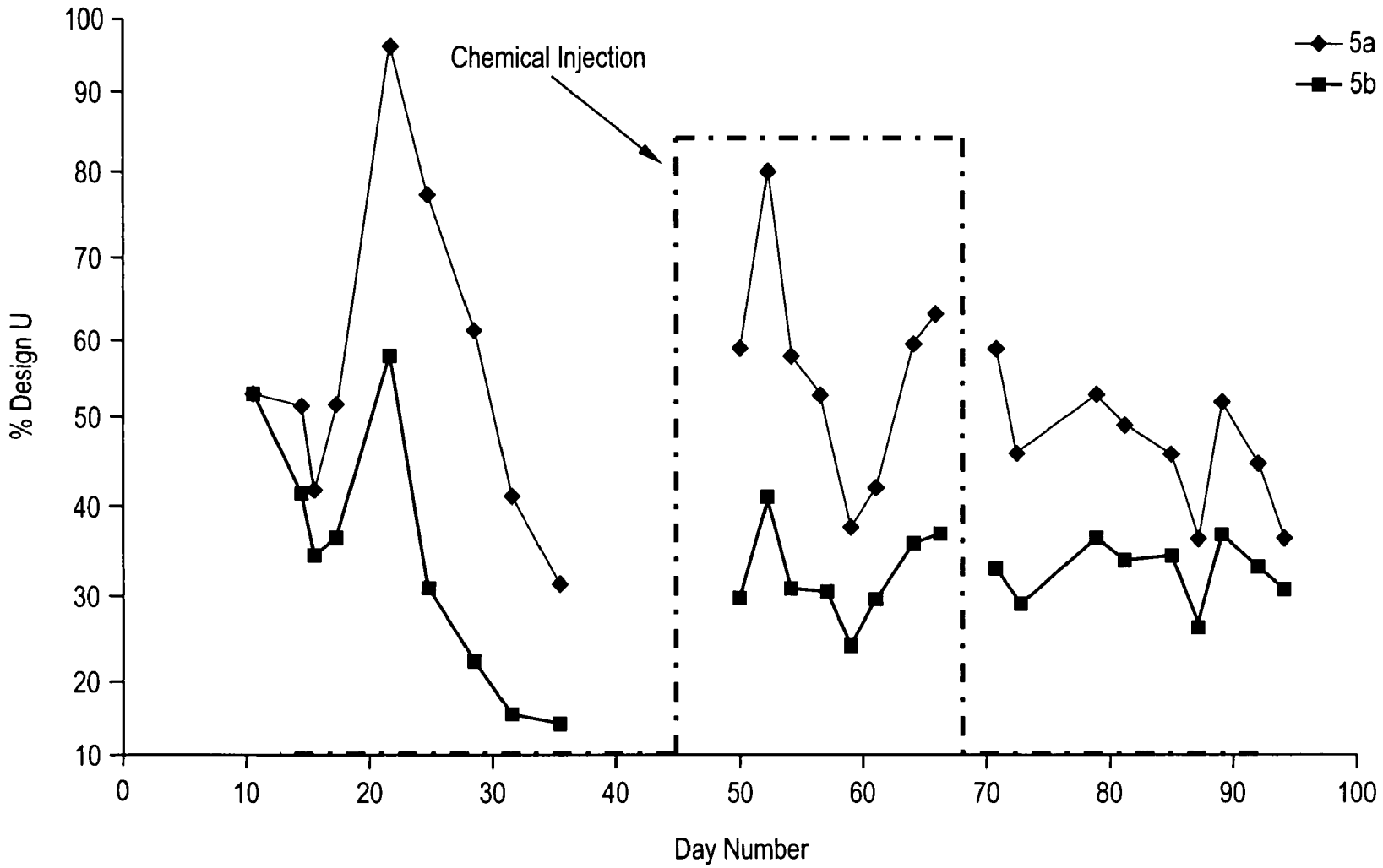
FIG. 4 is a plot of heat exchanger 5*a* and 5*b* efficiency data (as percent design U) vs time both before and after cleaning with organic solvents according to this invention.
Figure 5:
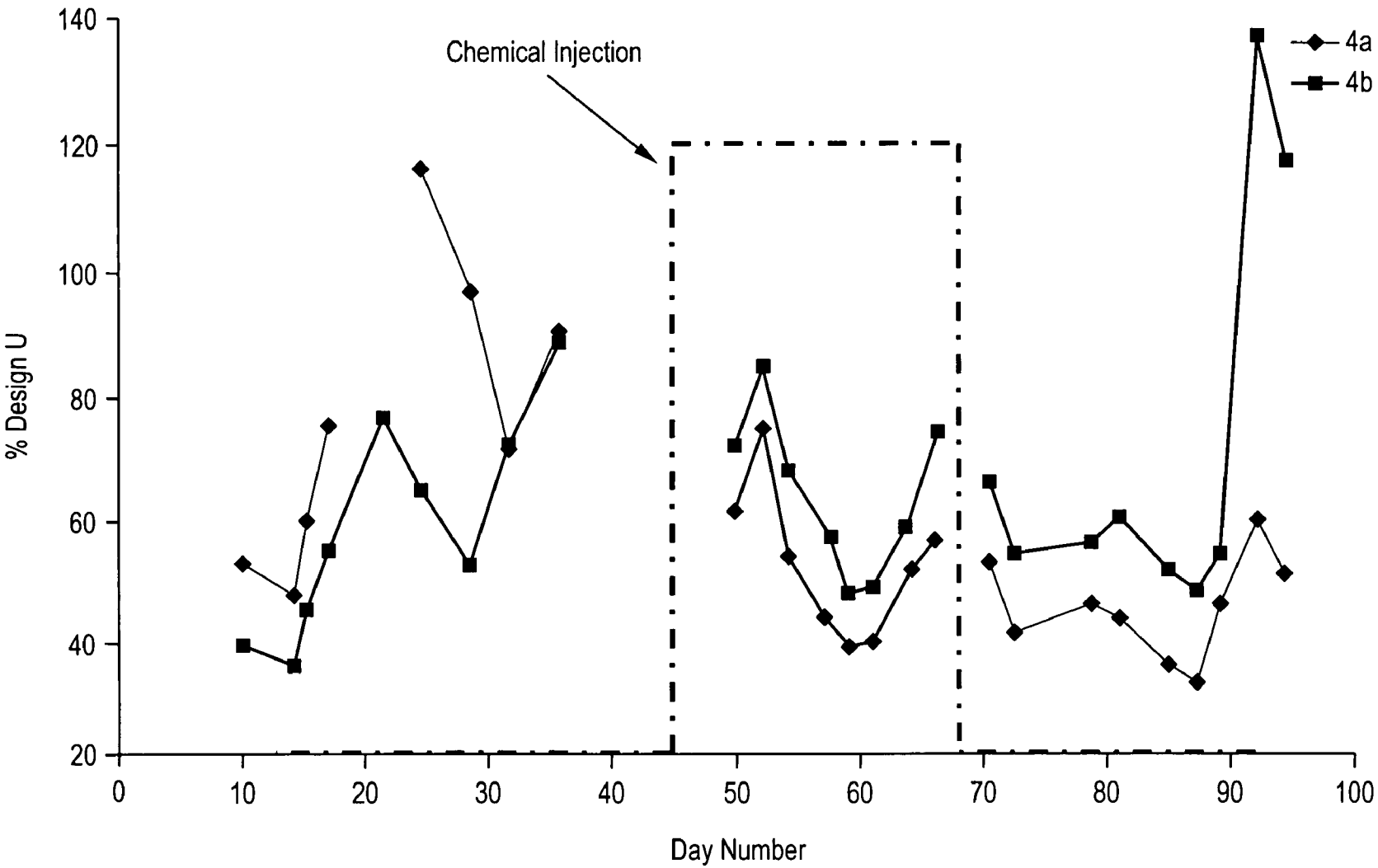
FIG. 5 is a plot of heat exchanger 4*a* and 4*b* efficiency data (as percent design U) vs time both before and after cleaning with organic solvents according to this invention.

FIGS. 4 and 5 show the top heat exchanger banks, 4*a* and 4*b* and 5*a* and 5*b*, respectively. Both banks are cleaned at about day 15 to immediately increase the U values. Subsequent to cleaning, the U-coefficients quickly decrease and, like the fin fans, the U coefficients show an immediate improvement once the DMP is injected.

Figure 6:
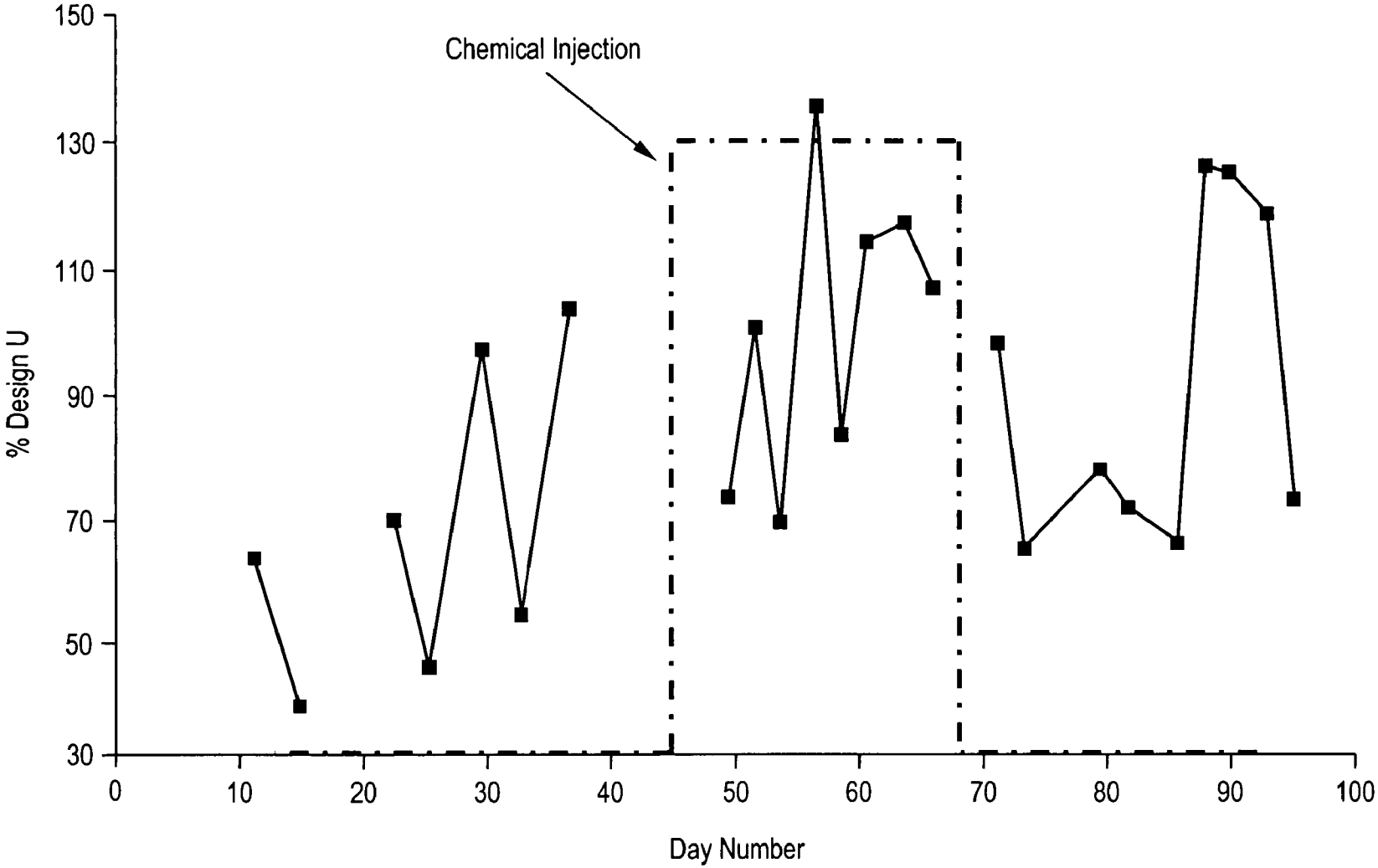
FIG. 6 is a plot of heat exchanger 7 efficiency data (as percent design U) vs time both before and after cleaning with organic solvents according to this invention.

FIG. 6 shows the heat exchanger 7 U value data. The exchanger U value is initially constant and then increases during the DMP injection. After the injection the U value trends sharply downward. Around day 85, the exchanger is cleaned, the U value returns, but quickly degrades. Another indication of the effectiveness of the cleaning method of this invention is the pressure differential across the quench water tower. In the top section, the pressure differential before the trial started is 15 pounds. After 4 days, the differential drops to 14 pounds and after one week, the pressure differential is down to 12.6 pounds. The overall tower pressure differential before the trial started is 21.7 pounds and after one week it is down to 18.9 pounds. The process engineer also reports that the overhead temperature of the quench tower has been reduced.

EXAMPLE 4

Cleaning of the Quench Water Separator Drum.

Figure 7:
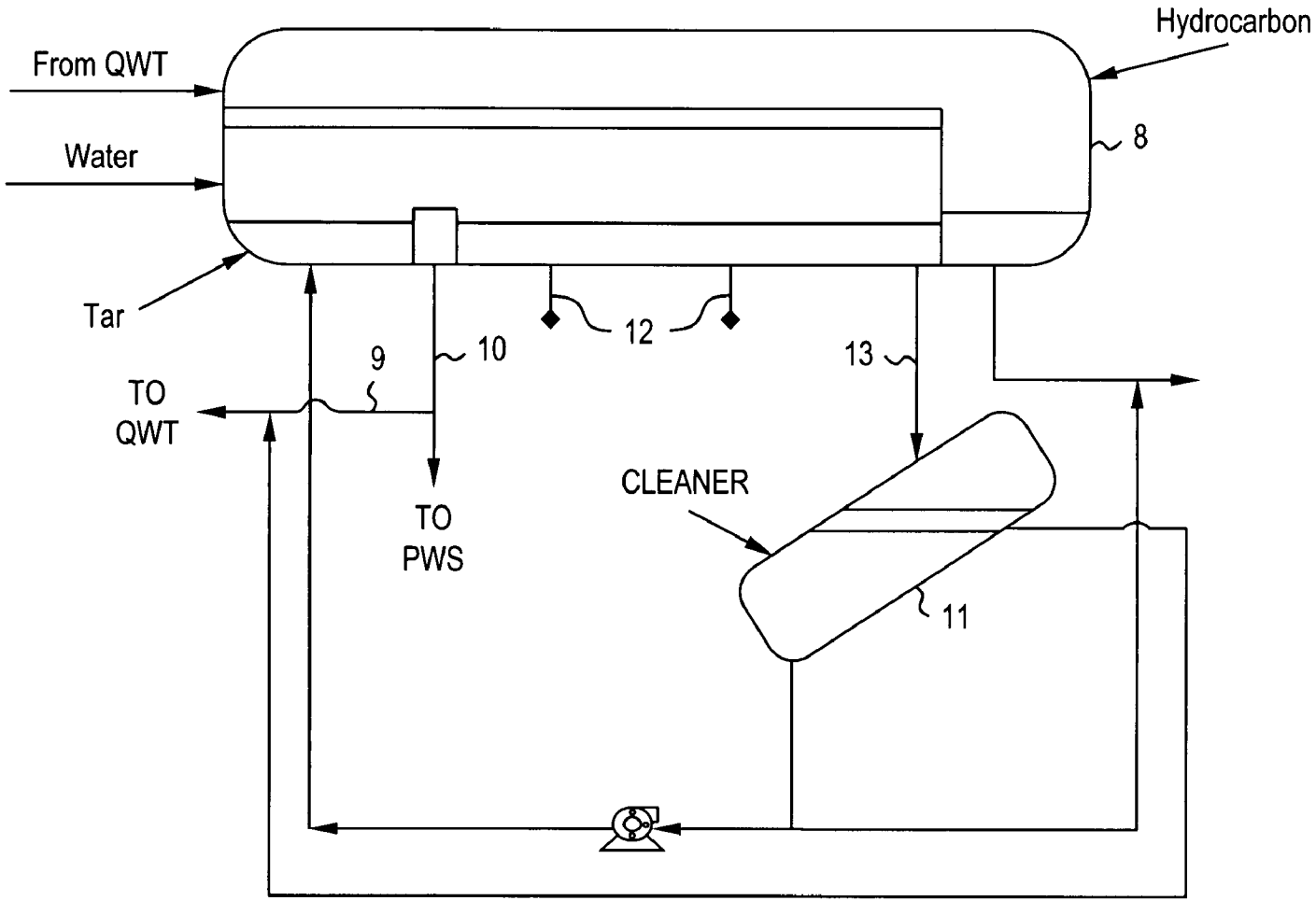
FIG. 7 is shows an embodiment of this invention in which an organic solvent as described herein is used for cleaning a quench water separator drum 8.

This example describes use of DMP as an antifoulant for the quench water separator drum (QWDS). The QWDS is shown schematically in FIG. 7. There is an inventory of tar along the bottom of the drum 8. As used herein, tar refers to the heavy foulant within the system and includes any tars, asphaltenes or coke fines. This layer of tar is getting drawn back into the return line 9 to the QWT and the line 10 to the process water stripper (PWS). Once it is returned to these units, the tar will foul the units and reduce the units' operational life times. The DMP is stored in a small tank 11. The solvent is injected into one of the bottom draws 12 in the separator drum and removed from another bottom draw 13 where it will be returned to the small storage tank 11. This recirculation continues until the solvent is saturated with the tar material. The tar-saturated solvent settles to the bottom of the small storage tank 11 where it is mixed with the hydrocarbon solvent and sent with the tar as a product to a refinery. Any water that is caught in the small storage tank is returned to the QWT.

Changes can be made in the composition, operation, and arrangement of the method of the invention described herein without departing from the concept and scope of the invention as defined in the claims.

The invention claimed is:

1. A method of dispersing, dissolving, or reducing the viscosity of hydrocarbon foulants in fluids in contact with hydrocarbon processing equipment comprising contacting the foulants with an effective dispersing, dissolving or reducing amount of a halogen-free, water-immiscible organic solvent having a density greater than water at the process temperature.

2. The method of claim 1 wherein the organic solvent is selected from the group consisting of phenols, phthalic acids, maleic acids, anisoles, cyanoacetic acids and combinations thereof.

3. The method of claim 1 wherein the organic solvent is selected from the group consisting of dimethyl maleate, diethyl phthalate, dimethyl phthalate, methyl cyanoacetate, 2-nitroanisole and combinations thereof.

4. The method of claim 1 wherein the organic solvent is selected from the group consisting of $C_1$-$C_3$ maleic acid alkyl esters and $C_1$-$C_3$ phthalic acid alkyl esters, combinations thereof.

5. The method of claim 4 wherein the organic solvent is selected from the group consisting of dimethyl maleate, diethyl phthalate, dimethyl phthalate and combinations thereof.

6. The method of claim 5 wherein the organic solvent is dimethyl phthalate.

7. The method of claim 1 wherein the hydrocarbon foulant is selected from the group consisting of heavy oil, tars, asphaltenes, polynuclear aromatic hydrocarbons, and coke.

8. The method of claim 1 wherein the hydrocarbon foulant is selected from the group consisting of polymers, light oil, oxidized hydrocarbon, and thermal decomposition products.

9. The method of claim 1 wherein the hydrocarbon processing equipment is refinery equipment.

10. The method of claim 9 wherein the refinery equipment is a hydrotreator.

11. The method of claim 1 wherein the hydrocarbon processing equipment is ethylene plant equipment.

12. The method of claim 11 wherein the hydrocarbon processing equipment is hydrotreating equipment.

13. The method of claim 11 wherein the hydrocarbon processing equipment is the compressor.

14. The method of claim 11 wherein the hydrocarbon processing equipment is acetylene convertor.

15. The method of claim 11 wherein the hydrocarbon processing equipment is the ethylene furnace.

16. The method of claim 11 wherein the hydrocarbon processing equipment is dilution steam system processing equipment.

17. The method of claim 16 wherein the hydrocarbon processing equipment is the quench water tower.

18. The method of claim 16 wherein the hydrocarbon processing equipment is the quench water separator.

19. The method of claim 11 wherein the hydrocarbon processing equipment is the bottom lines, storage tanks, vessels, pumps, and the like associated with the quench water separator drum.

* * * * *